US006446930B1

(12) United States Patent
Li

(10) Patent No.: US 6,446,930 B1
(45) Date of Patent: Sep. 10, 2002

(54) UMBRELLA BASE

(75) Inventor: Jun Li, Summerfield, NC (US)

(73) Assignee: Hanamint Corporation, Inc., Greensboro, NC (US)

( * ) Notice: Subject to any disclaimer, the term of this patent is extended or adjusted under 35 U.S.C. 154(b) by 0 days.

(21) Appl. No.: 09/418,692

(22) Filed: Oct. 14, 1999

Related U.S. Application Data

(60) Provisional application No. 60/104,841, filed on Oct. 18, 1998.

(51) Int. Cl.[7] ..... F16M 13/00

(52) U.S. Cl. ..... 248/519; 248/910; 135/15.1

(58) Field of Search ..... 248/910, 523, 248/519, 158; 211/62; 135/118, 48, 17, 19, 15.1

(56) References Cited

U.S. PATENT DOCUMENTS

| | | | | | |
|---|---|---|---|---|---|
| 524,894 | A | * | 8/1894 | Forsberg | 248/910 X |
| 1,735,671 | A | * | 11/1929 | Bunker | 248/910 X |
| 1,767,439 | A | * | 6/1930 | Edelmann | 248/910 X |
| 1,821,580 | A | * | 9/1931 | Rogers | 248/910 X |
| 1,877,098 | A | * | 9/1932 | Washburn | 248/910 X |
| 3,729,157 | A | * | 4/1973 | Haff | 248/519 |
| 3,794,279 | A | * | 2/1974 | Kramer | |
| 5,207,406 | A | | 5/1993 | Stine et al. | |
| 5,354,031 | A | * | 10/1994 | Bilotti | |
| 5,497,972 | A | * | 3/1996 | Sofy | |
| 6,113,054 | A | * | 9/2000 | Ma | 248/910 X |

FOREIGN PATENT DOCUMENTS

EP 08185941 A1 * 1/1998

* cited by examiner

*Primary Examiner*—Korie Chan
(74) *Attorney, Agent, or Firm*—Womble Carlyle Sandridge & Rice, PLLC

(57) ABSTRACT

An umbrella stand having an outer decorative surface is provided, for use with a large, outdoor-style umbrella. The outer surface of the stand is formed on an exterior shell that is fabricated out of a corrosion-resistant material, such as Aluminum. A weighted mass is attached to an inner surface of the exterior shell, thereby protecting the less corrosive-resistant material from the elements. Additionally, the weighted mass is attached to the exterior shell piece in a manner that none of the mass rests upon the surface on which the umbrella stand rests. In this manner, only the corrosion-resistant, decorative piece touches the support surface, preventing any discoloration that may occur upon the surface of the weighted mass from staining the area on which the umbrella stand rests—frequently a concrete surface.

13 Claims, 3 Drawing Sheets

UMBRELLA BASE

CROSS-REFERENCE TO RELATED APPLICATION

This application claims the benefit of U.S. Provisional Application, Serial No. 60/104,841, filed Oct. 18, 1998.

BACKGROUND OF THE INVENTION

1. Field of the Invention

The present invention relates to holders and, more particularly, to stands for holding umbrellas. More specifically, the present invention relates to stand for receiving large umbrellas of the type used outdoors to provide shade.

2. Description of the Prior Art

Sales trends for outdoor furniture suggest a growth of 6 to 7% through the year 2000. Much of this growth is predicted to come from new families and the increasing use of domestic areas for leisure and recreation. Additionally, recent years have shown a renewed interest in outdoor entertaining.

Although outdoor furniture can be enjoyed by a family in a simple setting, consumers are increasingly presented with a growing array of choices when buying casual outdoor furniture. Leading vendors in this category continue to drive the business with enhancements in areas such as features, function, and fashion. The "garden" influence has become prominent, with more ornate styling and value add-ons reflecting floral and ivy treatments. Recent trends reflect a demand by customers for outdoor furniture sets that are a little more innovative in terms of design features.

Permitting the manufacture of increasingly more intricate designs, new technologies also have greatly expanded the array of weather-resistant and durable materials available for outdoor furniture. Many of these materials can be safely placed outdoors, such as by a pool or in a green glade, for years or even decades without succumbing to the elements. Cushion fabrics that are indoors-soft but able to withstand exposure to sun and rain have considerably improved the "comfort" of outdoor furniture. Understandably, good-quality outdoor furniture that is both comfortable and durable cannot be obtained for the same cost as simple resin chairs.

In comparison to expensive, high-quality woods such as teak, wrought- and cast-iron pieces share a moderate price, a traditional look, and, with some items, a permanence born of being almost too heavy to budge. Unfortunately, iron of any sort has a weakness: unless properly finished and maintained, it rusts. Especially in areas near the ocean where any scratch in the finish will start that deterioration. In fact, iron furniture made in recent times is even more likely to degrade than that of years past. Environmental considerations now prohibit the former use of lead as a protective coating.

A more durable choice is provided by aluminum, which is used in all types of outdoor furnishings. In addition to its fabrication into a tubular frame, aluminum, like iron, can be wrought or cast to form elaborately designed pieces of the type suitable for placement on the White House lawn. Aluminum also provides a much lighter finished product. Such beneficial qualities result in a price premium charged for aluminum furniture, particularly for cast aluminum pieces of almost double that charged for similar cast-iron products.

These new technologies, combined with recent consumer lifestyle changes, have encouraged manufacturers to create and promote "good," "better," and "best" grades of casual outdoor furniture. As more entertaining is done in an around the home, there has been an increased demand for outdoor furnishings embodying new looks and designs. Even umbrella pedestals are receiving a facelift, reflecting this changed consumer demand.

Since umbrella pedestals must also provide stability for the opened umbrella, such pedestals have traditionally been fabricated out of heavy cast-iron. Its susceptibility to corrosion results not only in the deterioration of its outer appearance, but also creates a problem when rust particles stain the surrounding support surface. While aluminum would avoid these corrosion-based problems, the resulting casting would be too light to provide the necessary support and stability for the umbrella. A need exists for a decorative, aluminum-cast umbrella pedestal that is fabricated in a manner to provide sufficient ballast for stability as well as support for an opened umbrella placed therein.

SUMMARY OF THE INVENTION

It is an object of the present invention to provide an umbrella stand that is decoratively cast out of aluminum and that provides the heft necessary to stabilize the umbrella during outdoor use. In this regard, a decorative casting of a light material forms an outer cover for an inner disk that is fabricated out of a heavier material. The inner ballast material is retained within the outer casting in a manner that separates it from the surface upon which the stand rests. Thus if the inner disk material discolors over time, such discoloration is not transferred to the supporting surface.

In use, an outer decorative cover is cast (or otherwise fabricated) out of a lightweight material, in a manner that creates an interior space on the underside of the casting. A weighted disk made out of a more dense material is placed within this interior space, with the dimensions of the disk such that it does not extend to touch the support surface on which the outer cover rests. In this manner the weighted disk lends the necessary heft to the umbrella stand as is required to add stability when the umbrella is inserted into an opening formed in the outer cast. In addition to providing a decorative visual effect, the outer casting covers and protects the inner weighted disk, enabling the use of heavier and less expensive materials that are otherwise more susceptible to discoloring corrosion.

Some further objects and advantages of the present invention shall become apparent from the ensuing description and as illustrated in the accompanying drawings.

DETAILED DESCRIPTION OF THE PREFERRED EMBODIMENTS

Figure 1:
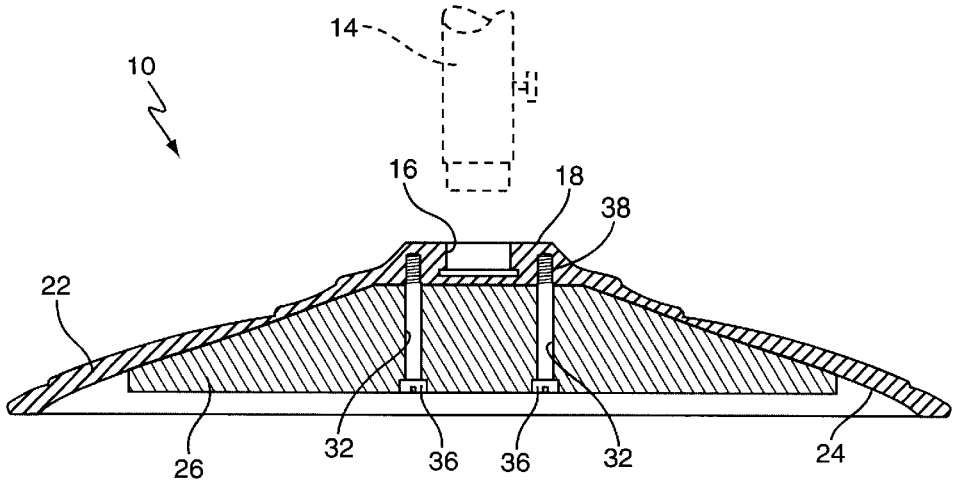
FIG. 1 is a cross-sectional view, with portions in phantom, showing an umbrella base in accordance with the present invention.

Reference is now made to the drawings wherein like numerals refer to like parts throughout. An umbrella base 10 is shown in FIG. 1, and is of the type suitable for receiving and temporarily retaining an umbrella support shaft 14. A shaft-receiving opening 16 is centrally formed in a flattened, top receiving surface 18 of the umbrella base 10.

The umbrella base 10 is constructed using an outer decorative cover 22 that provides a circular, substantially convex surface. An inner, concave surface 24 of the outer cover 22 is configured to receive an inner weight disk 26 of appropriate shape.

Figure 2:
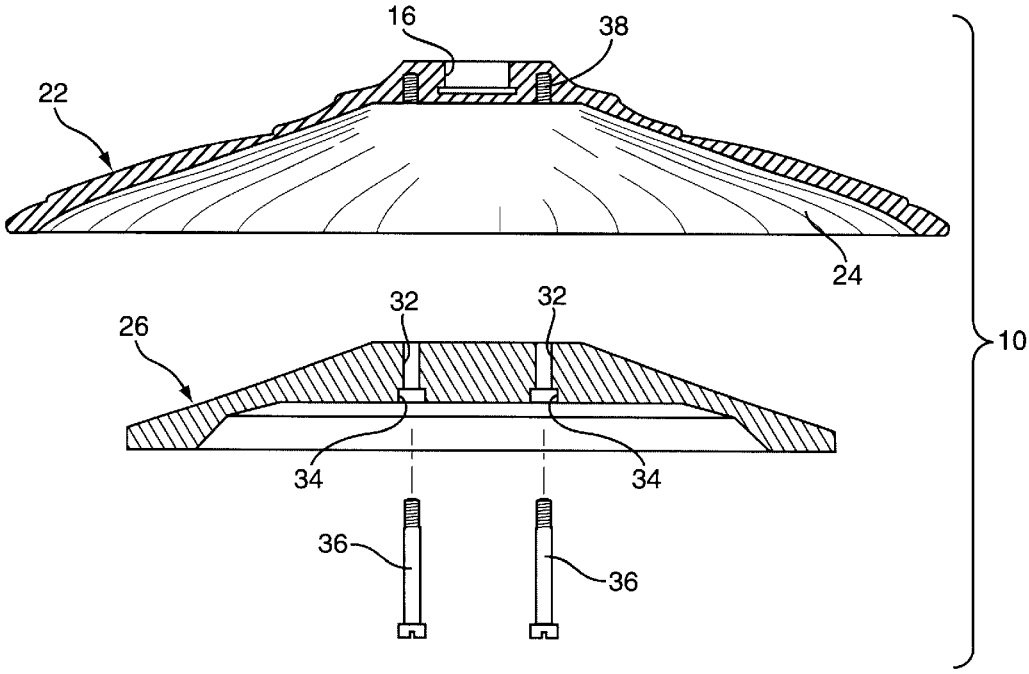
FIG. 2 is an exploded view, taken in cross-section, showing the component parts of an umbrella base in accordance with the present invention.

A variety of fastening devices can be used to attach the inner weight disk 26 to the inside surface of the outer decorative cover 22. In a presently preferred embodiment, a plurality of throughbores 32, each having a countersink 34 (see FIG. 2), are centrally-formed in the inner weight disk 26 and sized to receive a plurality of fastening bolts 36. A corresponding number of threaded ends 38 are centrally formed in the inner concave surface 24 of the outer decorative cover 22.

Attachment of the inner weight disk 26 to the outer decorative cover is then conventionally obtained (see FIG. 2) by passage of the fastening bolts through a respective one of the plurality of throughbores 32, for reception within one of the threaded ends 38.

Figure 3:
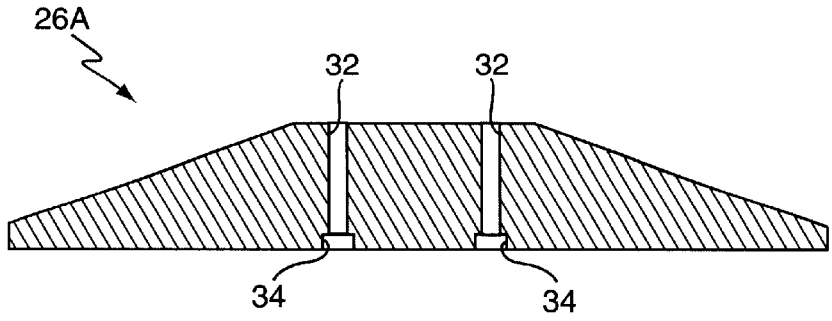
FIG. 3 is a cross-sectional view showing an alternative inner weight for use with an umbrella base in accordance with the present invention.

The present invention also contemplates permitting a variance in the overall weight of the umbrella base. In some instances, such as for use with umbrellas having larger diameter canopies (not shown in the Figures), the possibility of greater wind loads requires that the umbrella base 10 provide greater support. In FIG. 3, an enhanced weight disk 26A is shown having increased mass in comparison to the inner weight disk 26 of FIGS. 1 and 2. Such increase in mass enables the umbrella base 10 (not shown in FIG. 3) to resist the greater forces created both by the increase in weight of larger umbrellas, as well as the increased wind loading occasioned by the larger-diameter canopies.

Figure 4:
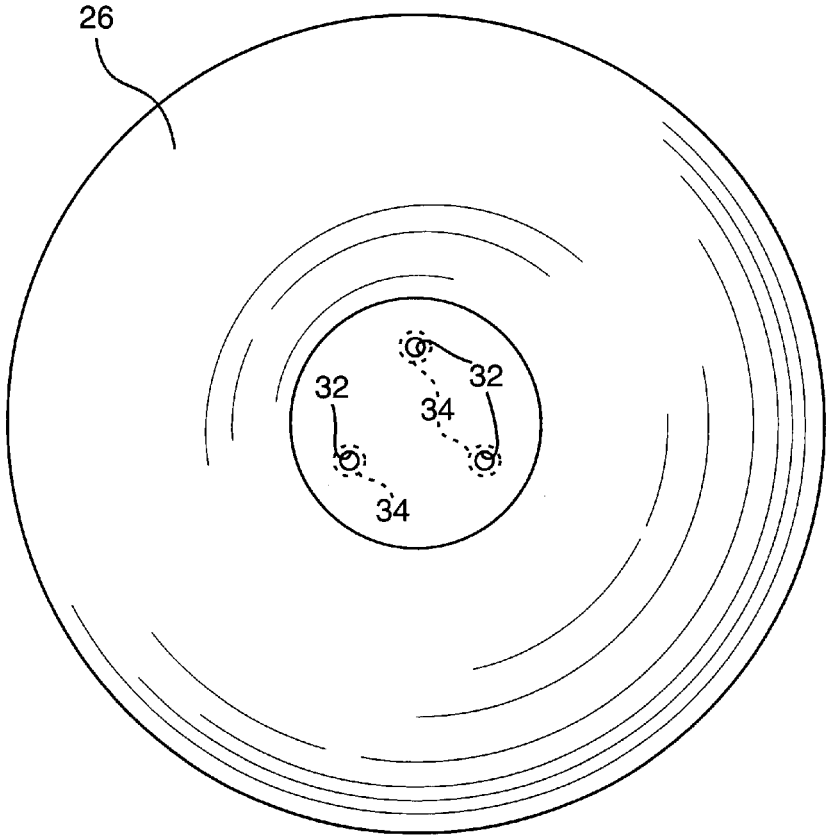
FIG. 4 is a top plan view showing an inner weight for use with umbrella base in accordance with the present invention.

The preferred placement of the inner weight throughbores 32 within the central, top-receiving surface 18 of the inner weight disk 26 is best shown in FIG. 4. Although disk-shaped in the Figures, other geometric shapes may be chosen for the inner weight disk 26 without departing from the teachings of the present invention.

Figure 5:
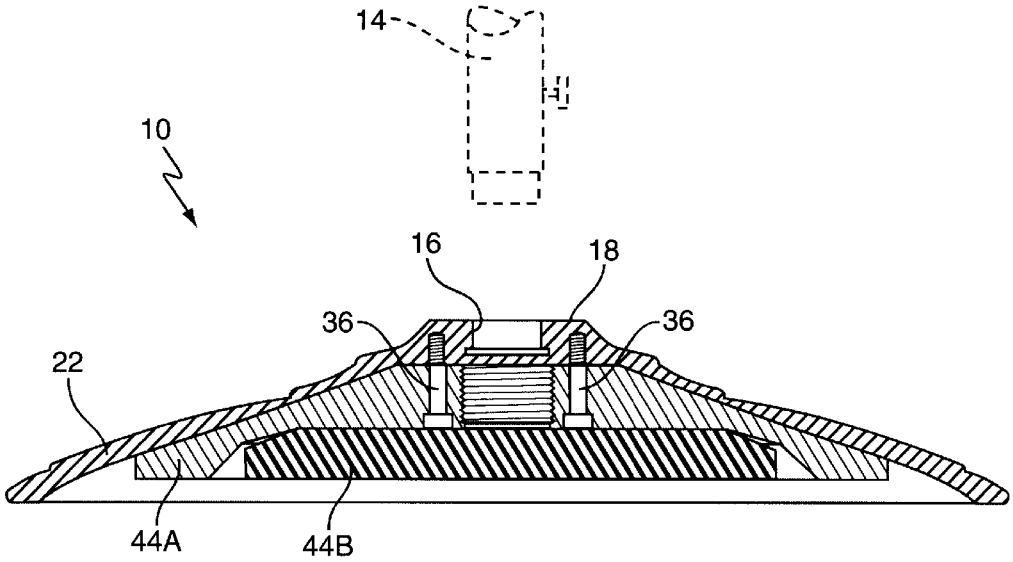
FIG. 5 is a cross-sectional view showing an umbrella base having an alternative weight-attachment mechanism in accordance with the present invention.

In FIG. 5 an umbrella base 10 is shown, having a pair of nested inner weights 44A, 44B. As will be further explained in the context of FIG. 6 below, the nested inner weights 44A, 44B provides an alternative method to make weight adjustments to the umbrella base 10.

Figure 6:
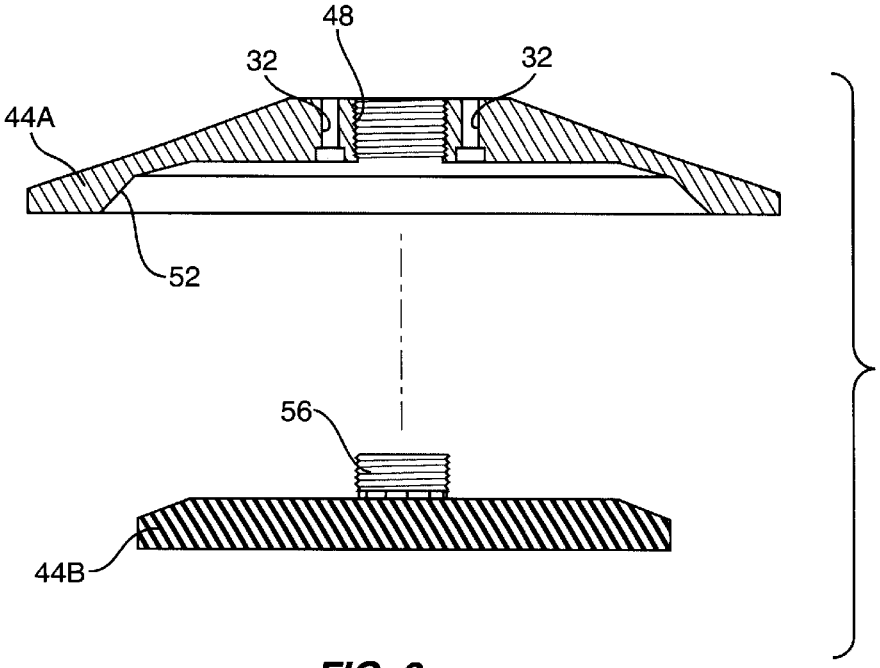
FIG. 6 is an exploded cross-sectional view of the weight-attachment mechanism of FIG. 5 in accordance with the present invention.

The upper nested inner weight 44A shown in FIG. 6 has a centrally-located, threaded shaft 48 formed therein. A nesting surface 52 is formed in an outer surface of the upper nested inner weight 44A, and is formed in a configuration suitable for receiving the lower nested inner weight 44B. The latter is provided a threaded stub 56 that is appropriately located on the lower inner weight 44B to permit its reception and securement within the threaded shaft 48. In this manner, it is contemplated that when additional weight is required for the umbrella base 10 (FIG. 5), the lower weight 44B can be easily attached to the upper inner weight 44A with no tools or other fastening mechanisms required.

In a preferred embodiment, the umbrella base 10 is fabricated out of cast aluminum and cast iron components. The outer decorative cover 22 is preferably of cast aluminum, which provides a decorative, corrosion-resistant surface. Aluminum is a light-weight material, and to provide heft, an inner weight disk of cast iron is attached to the underside of the aluminum decorative cover 22. As so located, the cast iron is substantially protected from the corrosive effects of exposure to the elements.

Additionally, in a preferred embodiment, the inner weight disk 26 is attached to the decorative cover 22 in a manner that separates the inner disk 26 from the support surface on which the umbrella base 10 rests. Such protective placement of the inner cast iron weight disk 22 lessens the opportunity for corrosion stains forming on the surface upon which the umbrella base 10 rests (frequently decorative brick or cement).

The thickness for the outer aluminum cover is preferably determined solely by the decorative surface design being cast. Generally, such a thickness would be approximately ½". For the purpose of supporting a standard umbrella under a table (having a shaft diameter of 1¾" and a canopy of up to 9 feet) , an umbrella base of 19½" is generally sufficient. For such a stand, the inner weight disk has dimensions of 17 " (diameter) and a thickness of approximately 1' in the center and ¾" at the outer edge will result in a cast iron disk that weighs approximately 40 lbs. When combined with the approximate 10-lb. weight of the aluminum cover, the base for a standard umbrella will weigh approximately 50 lbs.

When the umbrella is to be "free standing" (without the table), a greater weight is required to provide the desired stability. In a presently preferred embodiment, the thickness of the inner weight is increased to approximately 2¼" in the center and ¾" at the outer edge, resulting in an inner disk that weighs approximately 80 lbs. When formed of cast iron. However, in both cases, it is preferred that a ground clearance of approximately 1" be maintained between the inner weight and the underlying support surface.

My invention has been disclosed in terms of a preferred embodiment thereof, which provides an improved umbrella pedestal that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. An umbrella stand comprising:

(a) an outer cover having an open lower end, an inner surface, and an upwardly extending opening designed to receive a pole of an umbrella, the outer cover being designed to rigidly support the umbrella in a substantially upright position when the outer cover is positioned on a substantially flat support surface; and (b) a weighted disk removably fixed to the inner surface of the outer cover, the weighted disk being accessible and removable through the open lower end of the outer cover and being suspended within the outer cover such that a lowermost portion of the weighted disk is elevated from the substantially flat support surface when the outer cover is positioned on the surface.

2. An umbrella stand according to claim 1 wherein the outer, cover is constructed of a corrosion resistant material.

3. An umbrella stand according to claim 2 wherein the outer cover is constructed of aluminum.

4. An umbrella stand according to claim 3 wherein the outer cover is constructed of cast aluminum.

5. An umbrella stand according to claim 1 wherein the weighted disk is constructed of iron or steel.

6. An umbrella stand according to claim 5 wherein the weighted disk is constructed of cast iron.

7. An umbrella stand according to claim 1 wherein the outer cover is constructed of cast aluminum and the weighted disk is constructed of cast iron.

8. An umbrella stand according to claim 1 wherein the weighted disk is removably fixed to the outer cover by at least one removable fastener.

9. An umbrella stand according to claim 8 wherein the weighted disk is removably fixed to the outer cover by a plurality of removable fasteners.

10. An umbrella stand according to claim 1 wherein the outer cover includes a decorative outer surface.

11. An umbrella stand according to claim 1 wherein the upward extending opening is configured to receive and support an umbrella support tube for receiving the pole of the umbrella.

12. An umbrella stand according to claim 1 wherein at least a portion of the inner surface of the outer cover and at least a portion of the weighted disk are configured to substantially nest together when the weighted disk is fixed to the inner surface of the outer cover.

13. An umbrella stand according to claim 12 wherein the nesting portion of the inner surface of the outer cover has a substantially concave shape, and the corresponding nesting portion of the weighted disk has a substantially convex shape.

* * * * *